United States Patent [19]

Lerch

[11] Patent Number: 4,532,964

[45] Date of Patent: Aug. 6, 1985

[54] METHOD OF OPERATING AN AIR NOZZLE WEAVING MACHINE

[75] Inventor: Hansueli Lerch, Elgg, Switzerland

[73] Assignee: Gebrüder Sulzer Aktiengesellschaft, Winterthur, Switzerland

[21] Appl. No.: 554,077

[22] Filed: Nov. 21, 1983

[30] Foreign Application Priority Data

Dec. 24, 1982 [EP] European Pat. Off. ..... 82810564.3

[51] Int. Cl.[3] ..... D03D 47/30

[52] U.S. Cl. ..... 139/435

[58] Field of Search ..... 139/435; 226/97, 95

[56] References Cited

U.S. PATENT DOCUMENTS 4,245,677 1/1981 Suzuki ..... 139/435
4,262,707 4/1981 Suzuki ..... 139/435
4,392,517 7/1983 Takahashi ..... 139/435

FOREIGN PATENT DOCUMENTS 2328135 12/1979 Fed. Rep. of Germany ..... 139/435

*Primary Examiner*—Henry Jaudon
*Assistant Examiner*—Steven Shongut
*Attorney, Agent, or Firm*—Werner W. Kleeman

[57] ABSTRACT

In the method the auxiliary nozzles are used individually or in groups to form a pressure wave travelling together with the front end of the weft thread through the weaving shed. Individual auxiliary nozzles or groups of auxiliary nozzles are maintained in a cut-off position for a certain amount of time after the front end of the weft thread has passed, however, are again cut-in, particularly prior to the moment of time at which the weft insertion operation ends, so that a trailing travelling wave is formed. Using such method the air consumption can be maintained at low levels. Particularly when individual auxiliary nozzles are cut-in only for short intervals of time in the trailing travelling wave, a particularly low air consumption can be achieved. By employing a trailing travelling wave, a lower air pressure also can be used for generating the pressure wave travelling with the front end of the weft thread.

10 Claims, 11 Drawing Figures

PRIOR ART Fig. 11

METHOD OF OPERATING AN AIR NOZZLE WEAVING MACHINE

BACKGROUND OF THE INVENTION

The present invention relates to a new and improved method of operating an air nozzle or air jet weaving machine.

In its more particular aspects the present invention relates to a new and improved method of operating an air nozzle or air jet weaving machine comprising auxiliary nozzles distributed across a predetermined weaving width for generating a pressure wave travelling through the weaving shed together with a front end or leading portion of the weft thread to be inserted. In the method of the invention the auxiliary nozzles which have been passed by the front end of the weft thread are again cut-off prior to completion of the weft thread insertion.

Generally, all the auxiliary nozzles which have been passed by the front end of the weft thread are cut-off again prior to completion of the weft thread insertion with the exception of some auxiliary nozzles, particularly those which are situated closer to the catch side of the weaving machine. The latter, for example, may be even cut-in for the first time close to the end of the weft insertion operation.

In a prior art method of this kind as known, for example, from German Pat. No. 2,051,445, published May 19, 1971, the function of the auxiliary nozzles is exhausted upon accelerating the weft thread which is to be inserted at the tip or front section thereof. When the tip of the thread has passed a predetermined auxiliary nozzle, the same, after being cut-off again, remains inoperative until the end of the weft insertion operation.

SUMMARY OF THE INVENTION

Therefore, with the foregoing in mind, it is a primary object of the present invention to provide an improved method of operating an air nozzle or air jet weaving machine in which the air consumption is particularly low.

Another important object of the present invention aims at providing a method of operating an air nozzle or air jet weaving machine in which the energy consumption is particularly low.

Now in order to implement these and still further objects of the invention, which will become more readily apparent as the description proceeds, the method of the present development is manifested by the features that, at least one auxiliary nozzle which has been passed by the front end or leading portion of the weft thread is again cut-in at least one more time prior to completion of the weft insertion in order to thus support the weft thread.

There is thus achieved the beneficial result that those auxiliary nozzles which are intended to support the weft thread, to assist in conveying the same and to maintain the weft thread in an essentially straight configuration in the weaving shed, only again consume air and thus energy after a certain operating pause or intermission during which time they are cut-off. If desired, a trailing travelling wave or trailing pressure wave following the initially generated pressure wave travelling with and carrying the front end or leading portion of the weft thread can be generated by some few auxiliary nozzles which have already been passed by the front end or leading portion of the weft thread. The travelling or migrating pressure wave effective at the front end of the weft thread thus can be maintained at a shorter length and, correspondingly, the number of auxiliary nozzles generating the same can be maintained smaller. Corresponding conditions are true also for the subsequent or trailing travelling wave. The pressure of the trailing travelling wave can be smaller than the pressure of the pressure wave travelling with the front end of the weft thread. Furthermore, however, the pressure and thus the energy consumption in the pressure wave travelling with the front end of the weft thread can be generally smaller when a trailing travelling wave is used as compared to the case in which no trailing travelling wave is employed.

In another method as known, for example, from German Pat. No. 2,328,135, granted Dec. 19, 1974, auxiliary nozzles are also cut-off after the front end of the weft thread has passed the same. However, in this method those auxiliary nozzles which are intended to support the weft thread after the front end thereof has passed the same, remain continuously cut-in, i.e. from the moment of time at which they were cut-in upon passage of the front end of the weft thread until completion of the weft insertion operation. In such a design relatively large amounts of air are consumed for supporting the thread. Furthermore, it is also impossible, however, to generate a trailing travelling wave by means of which the pressure in the pressure wave travelling with the front end of the thread could be lowered.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 11 is a diagramatic illustration of a prior art method of operating the weaving machine shown in FIG. 1.

DETAILED DESCRIPTION OF THE PREFERRED EMBODIMENTS

Figure 1:
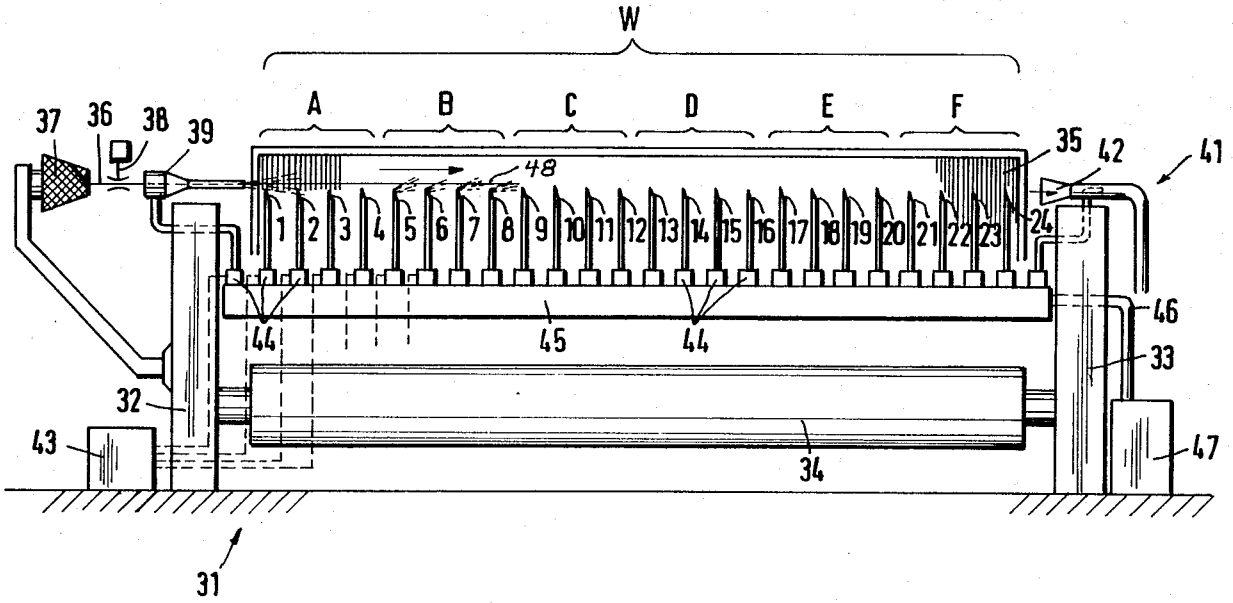
FIG. 1 is a schematic illustration of an air nozzle or air jet weaving machine as seen from the cloth or fabric side in which the method according to the invention is used.

Describing now the drawings, it is to be understood that only enough of the construction of the weaving machine or loom used for practicing the inventive method has been shown as needed for those skilled in the art to readily understand the underlying principles and concepts of the present development, while simplifying the showing of the drawings. Turning attention now specifically to FIG. 1, there has been schematically illustrated therein as viewed from the cloth or fabric side a weaving machine whicl has been generally designated in its entirety by reference character 31. This weaving machine or loom 31 contains two machine side members or cheek plates 32, 33. Therebetween a cloth beam or roller 34 and a reed 35 are arranged. The weft thread 36 is withdrawn from a stationary spool or bobbin 37. Subsequently, the weft thread 36 is guided through a weft thread brake 38 and then injected or inserted by a blowing-action provided by a main insertion nozzle 39 which is located outside the weaving shed defining a weaving width W. Auxiliary or secondary nozzles 1–24 are arranged and distributed across the weaving width W and protrude into the weaving shed W during the weft insertion. A suction nozzle 42 is arranged at the catch side 41 of the weaving shed.

The nozzles 39, 1 to 24 communicate, for example, via valves 44 controlled by any suitable electronic control means 43 with an air header or distributor pipe 45 which is supplied from a conventional compressed air container or air source 47 via an air supply conduit 46. The container 47 is maintained under pressure by an air compressor which is not shown in any particular detail.

Figure 2:
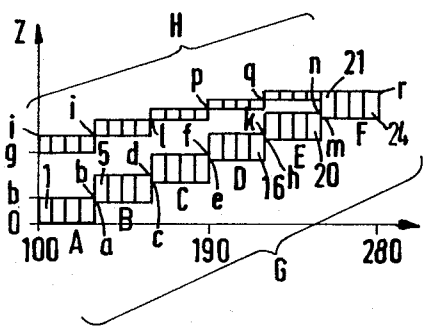
FIG. 2 is a diagramatic illustration of a first embodiment of the method according to the invention of operating the weaving machine shown in FIG. 1.

A first embodiment of the method according to the invention of operating the air nozzle or air jet weaving machine 31 is illustrated in FIG. 2. In the diagramatic illustration of such FIG. 2 the angular degrees of the main loom shaft in the range of from about 100° to about 280° are plotted on the abscissa while the blow period Z is plotted along the ordinate. Instead of such angular degrees or degrees of rotation of the loom shaft, length data corresponding to the weaving width could also be plotted along the abscissa.

The insertion of the weft thread 36 starts with the opening of the valves 44 which belong to the nozzles 39, 1 to 4, the latter of which form a first group A of the auxiliary nozzles 1 to 24. Simultaneously and at time zero the weft thread brake 38 is opened. At the moment of time which is designated "a" the front end or leading portion 48 of the thread is approximately located at the auxiliary nozzle 4, and at this time the second group B formed by the auxiliary nozzles 5 to 8 is cut-in. Shortly thereafter and at the moment of time designated "b", the group A of auxiliary nozzles 1 to 4 is cut-off. Now the group B takes over the front end 48 of the thread while the main weft insertion nozzle 39 continues to blow. In this way the weft thread 36 reaches the momentary position which is illustrated in FIG. 1 and in which the front end 48 of the thread is located between the auxiliary nozzles 8 and 9. At the moment of time designated "d" the group B of auxiliary nozzles 5 to 8 is cut-off. The front end or leading portion 48 of the weft thread 36 is now further conveyed by the nozzle group C comprising the auxiliary nozzles 9 to 12 until the moment of time designated "e" is reached. At the moment of time "e" the nozzle group D comprising the auxiliary nozzles 13 to 16 is cut-in and the nozzle group C comprising the auxiliary nozzles 9 to 12 is cut-off at the moment of time "f".

Shortly after the moment of time "f", while nozzle group D further conveys the front end 48 of the weft thread 36, nozzle group A comprising the auxiliary nozzles 1 to 4 is again cut-in at the moment of time designated "g", in order to thus support the rearward or trailing portion of the weft thread 36. Subsequently, and at the moment of time designated "h" the nozzle group E comprising the auxiliary nozzles 17 to 20 is cut-in and shortly thereafter, at the moment of time designated "i" the nozzle group A comprising the auxiliary nozzles 1 to 4 which have now operated as supporting nozzles are cut-off again. Simultaneously then the nozzle group B comprising the auxiliary nozzles 5 to 8 is cut-in again for a second time to function as supporting nozzles. At the moment of time designated "k" the nozzle group D comprising the auxiliary nozzles 13 to 16 is cut-off. At this time the weft thread 36 is further conveyed at its front end or leading portion 48 by the group E of auxiliary nozzles 17 to 20 which operate as drawing or traction nozzles and at its rear or trailing portion by the group B of auxiliary nozzles 5 to 8 which have been cut-in a second time to support the weft thread 36.

Finally, and at the moment of time designated "1", nozzle group B comprising auxiliary nozzles 5 to 8 is cut-off a second time and nozzle group C comprising auxiliary nozzles 9 to 12 now function as supporting nozzles in order to further carry the rear portion or section of the weft thread 36. Shortly thereafter and at the moment of time designated "m" the last nozzle group F comprising the auxiliary nozzles 21 to 24 is cut-in. Subsequently and at the moment of time "n" the nozzle group E comprising the auxiliary nozzles 17 to 20 is cut-off. Shortly thereafter and at the moment of time "p" the nozzle group C of auxiliary nozzles 9 to 12 is cut-off a second time while the group D comprising the auxiliary nozzles 13 to 16 is cut-in a second time. At the moment of time designated "q" the nozzle group D is cut-off a second time during the further operation and the nozzle group E comprising the auxiliary nozzles 17 to 20 is cut-in a second time. Finally, and in conclusion the nozzle groups F and E are cut-off at the moment of time designated "r". At this time the front end or leading portion 48 of the weft thread 36 is located at the region of the suction nozzle 42 which has been cut-in in the meantime, and the weft insertion operation is completed.

As will be evident from FIG. 2, the nozzle groups A to F of the auxiliary nozzles o.enerate a first pressure have or front end-pressure wave G which travels together with the front end 48 of the weft thread 36 through the weaving shed; during this operation the groups of nozzles A to F operate as drawing or traction nozzles. Thereafter the nozzle groups A to E are each cut-off in order to be successively cut-in a second time after a certain intermission or pause in the operation. During this second time the nozzle groups A to E generate a travelling wave H which trails the pressure wave G travelling together with the front end 48 of the weft thread 36 and wave G travelling together with the front end 48 of the weft thread 36 lasts from the moment of time zero to b, from a to d and so forth, and has the same length in all the nozzle groups A to F. Contrary thereto, the blow period of the nozzle group A lasts from g to i in order to generate the trailing travelling wave H. The blow period g to i for generating the trailing travelling wave H is smaller than the main blow period zero to b for generating the pressure wave G. Furthermore, the blow period of the individual nozzle groups generating the trailing travelling wave H successively decreases. For example, the blow period l to p of group C is shorter than the blow period i to l of group B. In turn, the blow period q to r is shorter than the blow period p to q of the preceding nozzle group.

Figure 3:
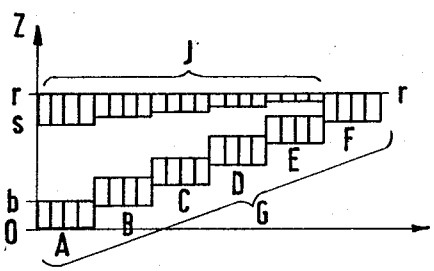
FIG. 3 is a diagramatic illustration of a second embodiment of the method according to the invention of operating the weaving machine shown in FIG. 1.

In the second embodiment as illustrated in FIG. 3, the pressure wave G travelling with the front end 48 of the weft thread 36 runs in.the same way as in the embodiment shown in FIG. 2, however, the trailing travelling wave J starts at a later time than the analogous wave H in FIG. 2. In this embodiment the nozzle groups A to E of the auxiliary nozzles exert a blowing action in order to generate the trailing travelling wave J until the completion of the weft insertion at r. For generating the trailing travelling wave J, the blow period s to r of nozzle group A is longer than the blow period zero to b of the same nozzle group A in the leading pressure wave G. However, the blow period for generating the trailing travelling wave J also successively decreases with the travelling front end or leading portion 48 of the weft thread 36.

Figure 4:
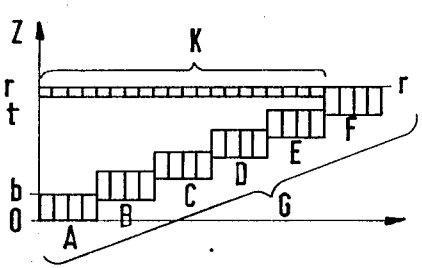
FIG. 4 is a diagramatic illustration of a third embodiment of the method according to the invention of operating the weaving machine shown in FIG. 1.

In the third embodiment as illustrated in FIG. 4 all nozzle groups A to E start at the same moment of time "t" in order to generate the trailing travelling wave K and blow until the completion of the weft insertion at r. The blow period t to r is shorter than the starting blow period s to r for generating the trailing travelling wave J illustrated in FIG. 3.

Figure 5:
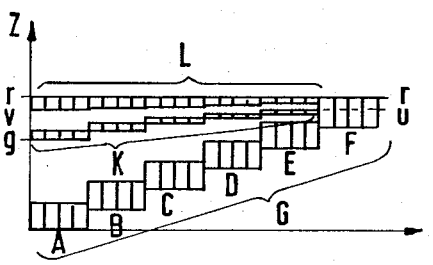
FIG. 5 is a diagramatic illustration of a fourth embodiment of the method according to the invention of operating the weaving machine shown in FIG. 1.

In the fourth embodiment as illustrated in FIG. 5 there is used a first trailing travelling wave K and a successive second trailing travelling wave L for the nozzle groups A to E. The first trailing travelling wave K runs in steps corresponding to the trailing travelling wave H illustrated in FIG. 2, however, ends at the moment of time u, and thus, prior to completion of the weft insertion at r. As compared thereto, the second trailing travelling wave L essentially corresponds to the trailing travelling wave J illustrated in FIG. 3. The second trailing travelling wave L merely starts at a somewhat later moment of time v, however, in this case like in the case of the trailing travelling wave J, all nozzle groups A to E blow until the completion of the weft insertion at r.

Figure 6:
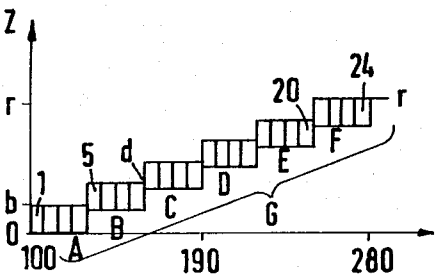
FIG. 6 is a diagramatic illustration of a fifth embodiment of the method according to the invention of operating the weaving machine shown in FIG. 1.
Figure 6:
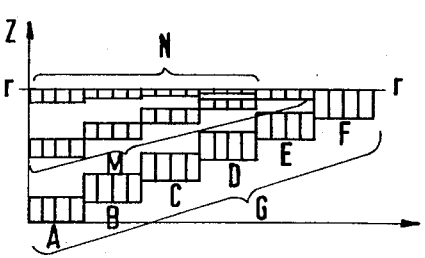

In the fifth embodiment as illustrated by FIG. 6 the two trailing travelling waves M and N extensively correspond to the trailing travelling waves K and L, respectively, as illustrated in FIG. 5. Only the blow period of nozzle groups A to E for generating the trailing travelling wave M is maintained longer as compared to the first trailing travelling wave K as illustrated in FIG. 5. Moreover, nozzle group E, in order to generate the trailing travelling wave M, blows until completion of the weft insertion at r, so that the cut-off of the nozzle group D which has been cut-in for a second time in order to generate the second trailing travelling wave N, forms the conclusion of the same.

Figure 7:
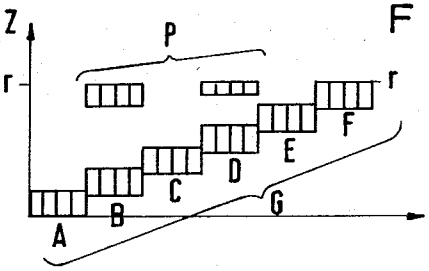
FIG. 7 is a diagramatic illustration of a sixth embodiment of the method according to the invention of operating the weaving machine shown in FIG. 1.

In the sixth embodiment as illustrated in FIG. 7, only the nozzle groups B and D still participate in generating the trailing travelling wave P, each of which blow until completion of the weft insertion at r.

Figure 8:
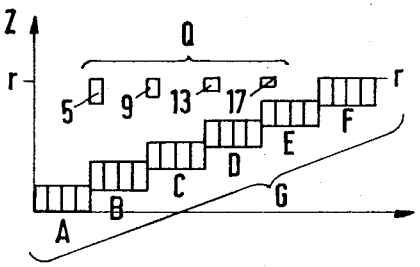
FIG. 8 is a diagramatic illustration of a seventh embodiment of the method according to the invention of operating the weaving machine shown in FIG. 1.

In the seventh embodiment as illustrated by FIG. 8, the entire groups of auxiliary nozzles 1 to 24 no longer participate in generating the trailing travelling wave Q. Only the individual auxiliary nozzles 5, 9, 13, 17 are still blowing, i.e. the respective first auxiliary nozzles of each of the groups B, C, D, E. The individual auxiliary nozzles blow until completion of the weft insertion at r for generating the trailing travelling wave Q.

Figure 9:
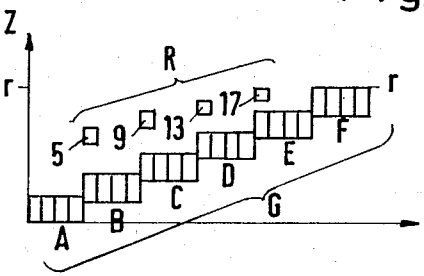
FIG. 9 is a diagramatic illustration of an eighth embodiment of the method according to the invention of operating the weaving machine shown in FIG. 1.

In the eighth embodiment as illustrated in FIG. 9, the auxiliary nozzles 5, 9, 13, 17 which operate to generate the trailing travelling wave R, are cut-off again in steps contrary to the illustration in FIG. 8. While the auxiliary nozzles 5, 9, 13 do not blow until completion of the weft insertion at r, the auxiliary nozzle 17 blows until r.

Figure 10:
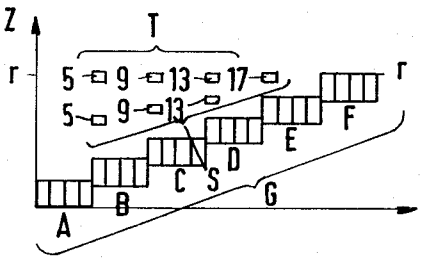
FIG. 10 is a diagramatic illustration of a ninth embodiment of the method according to the invention of operating the weaving machine shown in FIG. 1.

In the ninth embodiment as illustrated in FIG. 10, there is employed a first trailing travelling wave S generated by the auxiliary nozzles 5, 9, 13, 17 which corresponds to the trailing travelling wave R as illustrated in FIG. 9 and additionally a second trailing travelling wave T which corresponds to the trailing travelling wave Q illustrated in FIG. 8. Just the blow period for generating the trailing travelling waves S, T is shorter than that for generating the trailing travelling waves R, Q.

In conclusion and for comparison it is here remarked that the known method of operation employing only a single travelling wave G is illustrated in FIG. 11. In this prior art method none of the auxiliary groups A to F and none of the auxiliary nozzles 1 to 24 for generating the travelling wave G is again cut-in after being cut-off at b, d and so forth. There is no trailing travelling wave present therein in the manner as described hereinbefore.

When trailing travelling waves corresponding to those illustrated by any one of FIGS. 2 to 10 are used, the pressure to be maintained in the header 45 and in the container 47 can be kept at lower values as compared to the case in which there is present only a single pressure wave G travelling with the front end or leading portion 48 of the weft thread 36 corresponding to FIG. 11.

The individual groups of auxiliary nozzles serving to generate a trailing travelling wave also may comprise, for example, two or three auxiliary nozzles.

In general, the auxiliary nozzle will not be cut-off immediately after being passed by the front end or leading portion 48 of the weft thread 36 as such, but only after a certain front portion or section of the weft thread 36 has passed the auxiliary nozzle. The precedingly and frequently herein used term "front end of the weft thread" thus should be understood as being directed to a certain front portion or section of the weft thread which follows the actual tip thereof.

While there are shown and described present preferred embodiments of the invention, it is to be distinctly understood that the invention is not limited thereto, but may be otherwise variously embodied and practiced within the scope of the following claims. Accordingly,

What I claim is:

1. A method of operating an air nozzle weaving machine containing air-operated weft insertion means and comprising auxiliary nozzles distributed across a predetermined weaving width, comprising the steps of:

cutting-in said auxiliary air nozzles to generate a pressure wave travelling through a weaving shed of the weaving machine together with a front end of a weft thread which is to be inserted through said weaving shed;

cutting-off those ones of said auxiliary nozzles which have been passed by said front end of said weft thread prior to completion of the weft insertion;

again cutting-in at least one of said auxiliary nozzles which have been passed by said front end of said weft thread prior to completion of the weft insertion in order to support said weft thread; and again cutting-off said at least one renewed cut-in auxiliary nozzle prior to completion of said weft insertion.

2. A method of operating an air nozzle weaving machine containing air-operated weft insertion means and comprising auxiliary nozzles distributed across a predetermined weaving width, comprising the steps of:

cutting-in said auxiliary air nozzles to generate a pressure wave travelling through a weaving shed of the weaving machine together with a front end of a weft thread which is to be inserted through said weaving shed;

cutting-off those ones of said auxiliary nozzles which have been passed by said front end of said weft thread prior to completion of the weft insertion;

again cutting-in at least one of said auxiliary nozzles which have been passed by said front end of said weft thread prior to completion of the weft insertion in order to support said weft thread;

passing said weft thread through said weaving shed towards a catch side thereof; and successively shortening the time interval between the cut-off of said at least one auxiliary nozzle generating the pressure wave travelling together with said front end of said weft thread and the renewed cut-in of said at least one auxiliary nozzle for generating a trailing travelling wave the closer said at least one auxiliary nozzle is positioned to said catch side of said weaving shed.

3. A method of operating an air nozzle weaving machine containing air-operated weft insertion means and comprising auxiliary nozzles distributed across a predetermined weaving width, comprising the steps of:

cutting-in said auxiliary air nozzles to generate a pressure wave travelling through a weaving shed of the weaving machine together with a front end of a weft thread which is to be inserted through said weaving shed;

cutting-off those ones of said auxiliary nozzles which have been passed by said front end of said weft thread prior to completion of the weft insertion;

again cutting-in at least one of said auxiliary nozzles which have been passed by said front end of said weft thread prior to completion of the weft insertion in order to support said weft thread;

cutting-in said at least one auxiliary nozzle for a predetermined blow period; and shortening said blow period for generating a trailing travelling wave as compared to the blow period for generating said pressure wave travelling with said front end of said weft thread.

4. A method of operating an air nozzle weaving machine containing air-operated weft insertion means and comprising auxiliary nozzles distributed across a predetermined weaving width, comprising the steps of:

cutting-in said auxiliary air nozzles to generate a pressure wave travelling through a weaving shed of the weaving machine together with a front end of a weft thread which is to be inserted through said weaving shed;

cutting-off those one of said auxiliary nozzles which have been passed by said front end of said weft thread prior to completion of the weft insertion;

again cutting-in at least one of said auxiliary nozzles which have been passed by said front end of said weft thread prior to completion of the weft insertion in order to support said weft thread;

cutting-off said at least one renewed cut-in auxiliary nozzle for generating a trailing travelling wave only at the completion of the weft insertion;

passing said weft thread through said weaving shed towards a catch side thereof;

only cutting-in a limited number of auxiliary nozzles for generating a trailing travelling wave for a predetermined blow period; and successively shortening said predetermined blow period the closer aaid auxiliary nozzles are located towards said catch side of said weaving shed.

5. A method of operating an air nozzle weaving machine having a weaving shed with a predetermined weaving width, a main air nozzle for inserting a weft thread into the shed in a predetermined direction of weft insertion, and a plurality of auxiliary air nozzles distributed over the predetermined weaving width for reinforcing the main air nozzle in inserting the weft thread, comprising the steps of:

generating a pressure wave in the predetermined direction of weft insertion by successively activating and deactivating auxiliary air nozzles of the plurality of air nozzles; and wave generating at least one further pressure wave following said pressure wave by again activating and deactivating auxiliary air nozzles of at least a portion of the plurality of air nozzles.

6. The method as defined in claim 5, wherein:

the weaving machine has a catch side;

said pressure wave defining a weft thread front end travelling field;

said at least one further pressure wave defining at least one subsequent travelling field;

said step of generating said pressure wave entailing activating at least one auxiliary air nozzle of said auxiliary air nozzles;

said at least one auxiliary air nozzle having served to at least partially define said weft thread front end travelling field before being deactivated;

said step of generating said at least one further pressure wave entailing again activating said at least one auxiliary air nozzle;

said at least one auxiliary air nozzle serving to at least partially define said at least one subsequent travelling field after being again activated;

a predetermined temporal interval associated with each said at least one auxiliary air nozzle elapsing between deactivating said at least one auxiliary air nozzle and again activating said at least one auxiliary air nozzle;

said auxiliary air nozzles of the plurality of auxiliary air nozzles being distributed over the predetermined weaving width such that each successive said at least one auxiliary air nozzle is closer to the catch side of the weaving machine that each preceding said at least one auxiliary air nozzles; and said predetermined temporal interval being progessively shorter for auxiliary air nozzles of said plurality of auxiliary air nozzles which are progessively closer to said catch side of the weaving machine.

7. The method as defined in claim 5, wherein:

each auxiliary air nozzle of said auxiliary air nozzles has a first predetermined temporal duration between being activated to generate said pressure wave and being deactivated to cease generating said pressure wave;

each said auxiliary air nozzle having a second predetermined temporal duration between being again activated to generate said at least one further pressure wave and being again deactivated to cease generating said at least one further pressure wave; and said first predetermined temporal duration being greater than said second predetermined temporal duration.

8. The method as defined in claim 5, wherein:

said at least one further pressure wave defines at least one subsequent travelling field;

said step of generating said at least one further pressure wave entailing again activating only a selection of said auxiliary air nozzles of the plurality of auxiliary air nozzles;

the weaving machine having a catch side;

each auxiliary air nozzle of said auxiliary air nozzles having a predetermined temporal duration between being again activated to generate said at least one further pressure wave and being again deactivated to cease generating said at least one further pressure wave;

said auxiliary air nozzles of the plurality of auxiliary air nozzles being distributed over the predetermined weaving width such that each successive auxiliary air nozzle of said auxiliary air nozzles is closer to the catch side of the weaving machine than each preceding said auxiliary air nozzles; and said predetermined temporal duration being progressively shorter for auxiliary air nozzles of the plurality of auxiliary air nozzles which are progressively closer to said catch side of the weaving machine.

9. The method as defined in claim 5, wherein:

said pressure wave defines a weft thread front end travelling field;

said at least one further pressure wave defining a plurality of subsequent travelling fields;

said weft thread front end travelling field having a first predetermined characteristic pressure;

at least one subsequent travelling field of said plurality of subsequent travelling fields having a second predetermined characteristic pressure; and said first predetermined characteristic pressure being greater than said second predetermined characteristic pressure.

10. The method as defined in claim 5, wherein:

said pressure wave travels at a first predetermined velocity;

said at least one further pressure wave travels at a second predetermined velocity; and said second predetermined velocity being greater than first predetermined velocity such that said at least one further pressure wave approaches said pressure wave.

* * * * *

UNITED STATES PATENT AND TRADEMARK OFFICE

CERTIFICATE OF CORRECTION

PATENT NO. : 4,532,964

DATED : August 6, 1985

INVENTOR(S) : HANSUELI LERCH

It is certified that error appears in the above—identified patent and that said Letters Patent is hereby corrected as shown below:

Column 4, line 53, please delete "o.enerate" and replace it with --generate--
Column 4, line 54, please delete "have" and replace it with --wave--
Column 4, line 64, after "and" please insert --operate as supporting nozzles. The blow period in the pressure--
Column 8, line 14, please delete "aaid" and replace it with --said--
Column 8, line 27, please delete "wave".

Signed and Sealed this

*Twenty-sixth* Day of *November 1985*

[SEAL]

*Attest:*

DONALD J. QUIGG

*Attesting Officer*

*Commissioner of Patents and Trademarks*